United States Patent [19]

Johnston et al.

[11] 4,329,114

[45] May 11, 1982

[54] ACTIVE CLEARANCE CONTROL SYSTEM FOR A TURBOMACHINE

[75] Inventors: Richard P. Johnston, Morrow, Ohio; Malcolm H. Knapp, South Lynnfield; Charles E. Coulson, Danvers, both of Mass.

[73] Assignee: The United States of America as represented by the Administrator of the National Aeronautics and Space Administration, Washington, D.C.

[21] Appl. No.: 60,449

[22] Filed: Jul. 25, 1979

[51] Int. Cl.[3] ..... F01D 25/14

[52] U.S. Cl. ..... 415/145; 415/178; 60/726; 60/39.29; 60/39.07

[58] Field of Search ..... 415/116, 117, 27, 108, 415/145, 176, 178; 60/39.07, 39.83, 726, 39.29, 226

[56] References Cited

U.S. PATENT DOCUMENTS

| | | | |
|---|---|---|---|
| 2,837,270 | 6/1958 | Chapman | 415/145 |
| 2,848,156 | 8/1958 | Oppenheimer | 415/108 |
| 3,108,767 | 10/1963 | Eltis | 415/145 |
| 3,945,759 | 3/1976 | Bobo | 415/145 |
| 3,966,354 | 6/1976 | Patterson | 415/116 |
| 3,975,901 | 7/1976 | Hallinger | 60/39.14 |
| 4,019,320 | 4/1977 | Redinger | 415/116 |
| 4,069,662 | 1/1978 | Redinger | 60/226 R |
| 4,127,357 | 11/1978 | Patterson | 415/116 |
| 4,213,296 | 7/1980 | Schwarz | 415/116 |

FOREIGN PATENT DOCUMENTS

| | | |
|---|---|---|
| 1491112 | 7/1976 | United Kingdom . |
| 2010979 | 7/1979 | United Kingdom . |
| 2025536 | 1/1980 | United Kingdom . |

*Primary Examiner*—Robert E. Garrett

*Attorney, Agent, or Firm*—Derek P. Lawrence; Norman T. Musial; Dana F. Bigelow

[57] ABSTRACT

An axial compressor is provided with a cooling air manifold surrounding a portion of the shroud, and means for bleeding air from the compressor to the manifold for selectively flowing it in a modulating manner axially along the outer side of the stator/shroud to cool and shrink it during steady-state operating conditions so as to obtain minimum shroud/rotor clearance conditions. Provision is also made to selectively divert the flow of cooling air from the manifold during transient periods of operation so as to alter the thermal growth or shrink rate of the stator/shroud and result in adequate clearance with the compressor rotor.

17 Claims, 2 Drawing Figures

ACTIVE CLEARANCE CONTROL SYSTEM FOR A TURBOMACHINE

The invention herein described was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates generally to gas turbine engines and, more particularly, to an apparatus for minimizing rotor/shroud and stator/rotor clearance during steady-state and transient operation.

As turbine engines continue to become more reliable and efficient by changes in methods, designs and materials, losses which occur from excessive clearances between rotors/shrouds and stator/rotor become more important in the many design considerations. Originally, the primary efforts in regard to clearance control were directed to the turbine/shroud relationship, whereas recently these considerations are being given to control of the compressor rotor/shroud and stator/-rotor relationship.

In many turbine engine applications, there is a requirement to operate at various steady-state speeds and to transit between these speeds as desired in the regular course of operation. For example, in a jet engine of the type used to to power aircraft, it is necessary that the operator be able to transit to a desired speed whenever he chooses. The resulting temperature and rotor speed changes bring about attendant relative growth between the rotor and the surrounding shroud/stator and, in order to maintain the desired efficiency, this relative growth must be controlled. The object is to maintain a minimum clearance between the stator and rotor while preventing any interference therebetween which would cause rubbing and resultant increase in radial clearance during subsequent operation. When considering the transient operating requirements, as mentioned hereinabove, the relative mechanical and thermal growth patterns between the rotor and the shroud present a very difficult problem. If the system were to operate only under steady-state conditions, it would be a relatively simple matter to establish the desired close clearance relationship between the rotor and the stator to obtain the greatest possible efficiency without allowing frictional interference between the elements. However, in order to accommodate the transient operation requirement, the engine is generally designed so as to have adequate clearance during the most extreme relative growth operating condition; usually for hot rotor rebursts. Thus, during other operating conditions, including that of the cruise where the engine running time is generally the greatest, the clearance between the components can be greater than the minimum clearance desired for maximum efficiency.

One method of minimizing the tip clearance of turbomachines has been to properly select the various materials which exhibit thermal properties that will assist in matching the radial responses of the rotor and shroud at different engine operating conditions. Thus, the thermal coefficient of the shroud material or that of the shroud support material is a very important design consideration. However, that alone is not sufficient to provide for adequate clearance control.

Another approach has been to flow cooling air over the shroud structure or the shroud support structure in order to better match the thermal growth patterns of the rotor. Provision has even been made to vary the temperature or the flow rate of the cooling air as, for example, by the use of compressor air whose flow or temperature may naturally vary with the changes in speed of the engine. Such a passive system does provide improved clearance characteristics but may still be inadequate for attaining best possible efficiency.

It is, therefore, an object of this invention to provide a turbomachine which operates at increased overall efficiency and performance levels.

Another object of this invention is the provision for controlling the clearance between rotor/shroud and stator/rotor components of a turbomachine.

Yet another object of this invention is the provision for minimizing clearance between a rotor and shroud during both transient and steady-state operation.

Still another object of this invention is the provision for a clearance control system which is effective in use and economical in operation.

Yet another object of this invention is the provision for setting optimum clearances for such conditions, as engine starting, and during periods of operation, such as sea level takeoffs when larger clearances are needed for expected high maneuver loads and engine rotor-to-stator relative deflection.

These objects and other features and advantages become more readily apparent from reference to the following description when taken in conjunction with the appended drawings.

SUMMARY OF THE INVENTION

Briefly, in accordance with one aspect of the invention, there is provided a manifold surrounding a portion of the compressor stator/shroud, and means for injecting the flow of cooling air into one end of the manifold and allowing it to flow therethrough along the outer surface of the shroud and shroud supporting structure, and discharging it for another use at the downstream end of the manifold. In this way, the stator/shroud temperature, and thus its thermal growth, is controlled in order to better control the clearance between the stator/shroud and the internal rotor.

By another aspect of the invention, there is provided a valve means which can be operated to selectively divert the flow of cooling air from the manifold during periods of transient operating conditions so as to allow the stator/shroud temperature to rise and thus to thermally grow or retain heat and accommodate any mechanical and thermal growth of the rotor during that period of operation.

By yet another aspect of the invention, the cooling air is bled off from the compressor into a plenum where it is then selectively made to flow either through the cooling manifold for cooling the stator/shroud and then into an exit duct for cooling other components or, it is allowed to flow directly into the exit duct, thus bypassing the shroud cooling, or any combination of flow through the cooling manifold and the exit duct.

In the drawings as hereinafter described, a preferred embodiment is depicted; however, various other modification and alternate constructions can be made thereto without departing from the true spirit and scope of the invention.

DESCRIPTION OF THE PREFERRED EMBODIMENT

Figure 1:
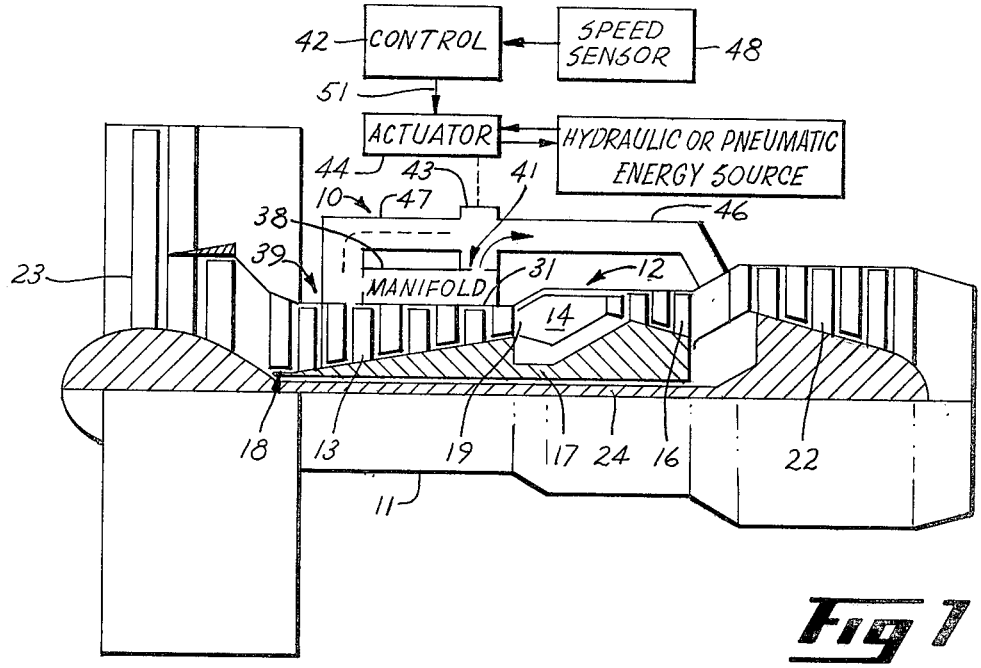
FIG. 1 is a schematic illustration of a gas turbine engine having the present invention incorporated therein.

Referring to FIG. 1, the invention is shown generally at 10 as incorporated in a turbofan engine 11 having a core engine 12 which comprises in serial flow relationship a compressor 13, a combustor 14, and a high pressure turbine 16. The compressor 13 is drivingly connected to the high pressure turbine 16 by a core rotor 17 and operates to receive relatively low pressure, cool air at the compressor inlet 18 and to discharge it at the compressor discharge point 19 at an increased pressure and temperature condition. Fuel is then mixed with high pressure air and ignited in the combustor 14 to further increase the temperature prior to its entering the high pressure turbine 16. After passing through the high pressure turbine 16, the gas is then passed through the low pressure turbine 22 which, in turn, drives the fan 23 by way of an interconnecting, low pressure shaft 24.

Figure 2:
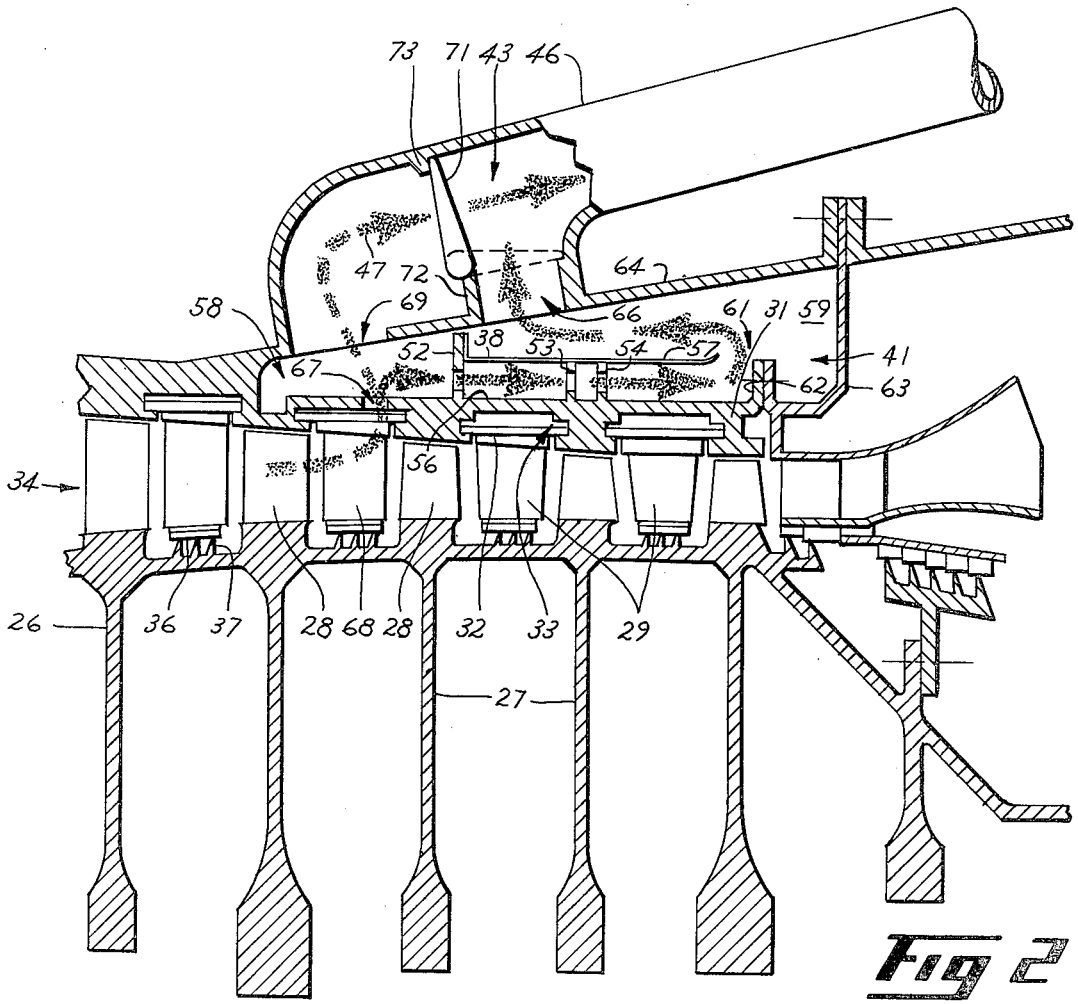
FIG. 2 is an axial cross-sectional view of the compressor upper portion thereof with the present invention incorporated therein.

The axial compressor 13 is shown in greater detail in FIG. 2 to include a spool or rotor 26 comprised of a plurality of axially spaced discs 27 with each supporting on its outer periphery a row of compressor blades 28. Alternately placed between adjacent rows of blades 28 are rows of circumferentially spaced vanes 29 which are attached to and supported by a cylindrical casing or stator structure 31. The vanes 29 are secured to the stator structure 31 in a conventional manner such as, for example, by the fitting of vane bands 32 into T-shaped circumferential slots 33 in the stator structure.

At the radially inner side of the compressor flowpath 34, the interface between the stationary vanes 29 and the rotating rotor 26, has a sealing arrangement provided by mutual engagement of a honeycomb structure 36 attached to the ends of the vanes 29 and a multi-toothed labyrinth seal 37 on the drum or rotor 26. The teeth of the seal 37 fit into grooves worn in the honeycomb 36 to establish a barrier against axial flow of the compressor air between the vanes and the rotor.

On the outer side of the flowpath 34, such a sealing arrangement in not practical. Even though in a relatively low speed application such as, for example, a low pressure turbine, a "blade shroud" can be attached to the outer ends of the blades so as to engage a honeycomb surface on a stationary shroud, it would be difficult to make such an attachment for a high speed compressor rotor. Accordingly, this interface, as well as that on the inner side of the flowpath 34, without some accommodation for relative growth between the rotor and stator, will allow air leakage past the blade tips and will be a cause for loss of efficiency. The present invention is thus intended as an improvement for such a structure.

Referring to both FIGS. 1 and 2, the inventive apparatus includes a cooling air manifold 38 attached to and surrounding the outer side of a portion of the stator structure 31. Describing the invention in general terms, as shown in FIG. 1, the manifold 38 has a cooling air delivery means shown generally at 39 for delivering air to the front end of the manifold 38 and a cooling air discharge means shown generally at 41 for receiving the discharge from the downstream end of the manifold 38. Cooling air is delivered to the manifold 38 on a selective basis by operation of a control mechanism 42, which moves a valve means 43 by conventional means such as a hydraulic or pneumatic actuator 44. Alternatively, the control 42 may cause the cooling air to pass directly to an exit duct 46 along the flowpath 47. Of course, the valve means 43 may be modulated to an intermediate position to provide a combination of flows in the manifold 38 and the air delivery means 39. The exit duct 46 thus receives the cooling air either from the cooling air manifold 38 along the cooling air discharge means 41, or directly from the air delivery means 39 along the flowpath 47, or from a combination thereof. This air then passes downstream and is used for cooling the high and/or low pressure turbine components in a conventional manner.

The control mechanism 42 operates in response to selected engine operating parameters. In the preferred embodiment a sensor 48 detects the core speed, and the resultant output signal passes along line 51 to the control mechanism 42. Specific details of the operation will be more fully described hereinafter.

Directing attention now to the specific structure of the preferred embodiment, as shown in FIG. 2, the cooling air manifold 38 comprises a flow separator or a front fin 52 and intermediate fins 53 and 54 attached to the outer surface 56 of the stator structure 31 and extending radially outward to an outer cover 57 which forms the outer boundary of the air flowing through the manifold 38. A plurality of holes are provided in the front 52 and intermediate fins 53 and 54 for the conduit of cooling air rearwardly from a supply cavity 58 through the manifold 38 along the stator structure outer surface 56 and to a discharge cavity 59 which forms part of the cooling air discharge means 41. Fluid communication between the manifold 38 and the discharge cavity 59 is provided by a discharge port 61 formed between the manifold outer cover 57 and a rear flange 62 extending radially outward from the stator structure 31. The discharge cavity 59 is defined by a rear casing 63 and an outer casing 64, in addition to the cooling air outer cover 57. An opening 66 is provided in the outer casing 64 to provide fluid communication between the discharge cavity 59 and the exit duct 46 via the valve means 43. Flow of air through this opening is controlled in a manner to be described hereinafter.

The air supply cavity 58 is defined by the stator structure 31, the manifold front fin 52, and the outer casing 64. Provision is made for cooling air to enter the supply cavity 58 by way of a plurality of entrance ports 67 formed in the stator structure 31. Cooling air flows from the compressor flowpath 34, through the vane row 68, the entrance ports 67, and into the supply cavity 58 where it may flow either into the cooling air manifold 38 or be diverted into the exit duct 46 by way of the opening 69.

To control the flow of the cooling air between the two possible flowpaths, there is provided in the exit duct 46 a flapper or similar two-way valve 71 pivotally mounted on the annular flange 72 and operable between an active position as shown by the solid line, and an inactive position as shown by the dotted line. When the active position, the flapper valve 71 engages the stop 73 to block the flow of air from the opening 69 and cause it to flow through the cooling air manifold 38, and the discharge cavity 59, through the opening 66 and into the exit duct 46. When the flapper valve 71 is placed in the inactive position as shown by the dotted lines, the flow of air through the cooling air manifold is diverted and the air from the supply cavity 58 passes through the opening 69 and into the exit duct 46. Intermediate positions of the flapper valve 71 proportion the flow of cooling air between the manifold 38 and the opening 69.

In most normal steady-state operating conditions of the engine, the control 42 causes the flapper valve 71 to be placed in the active position such that the cooling air flows over the stator outer surface 56 and impinges on the structural casing fins to maintain a desired lower temperature of the stator casing structure 31. The effect is to reduce the size of the stator casing 31 and bring the stator/rotor clearance to a minimum. During transient operation, such as in throttle chops, bursts, and rebursts, the speed sensor 48 senses the change in speed and the resultant signal passes along line 51 to the control 42 which, in turn, modulates the system by moving the flapper valve 71 between the fully active and the inactive position. Generally, during significant accelerations the cooling air is initially permitted to flow through the manifold 38 and, because of the resultant increase in pressure, it tends to heat the stator and cause it to thermally grow. During significant deceleration, on the other hand, the flow through the manifold 38 is shut off and the stator is allowed to retain its heat and therefore shrink slowly.

The system thus provides for reduced clearances during a steady-state operation to thereby bring about better efficienies. Transient conditions are accommodated by temporarily turning off the system to prevent rubs.

It will, of course, be understood that various other designs and configurations can be employed to achieve the objects of the present invention. For example, it will be recognized that the control system may be made to respond to throttle position, temperatures, pressures, clearances, or time delay. Further, the valve means may be of a type other than a flapper valve and may be operated either by hydromechanical, pneumatic, electronic or other means.

Further, even though the valve has been described as an on-off valve, it may be operatlve at other positions as well. For example, it may be desired to have some air always flowing through the cooling manifold, in which case the valve would never be completely closed as shown by the dotted lines. Also, the valve may be modulated to any intermediate position between those shown in FIG. 2. It should also be understood that, even though the invention has been described generally as being active when the engine is operating in a steady-state condition and inactive (on-off) when operating in a transient condition, the cooling system may also be controlled in respect to other parameters or operating conditions. For example, during aircraft climb it may be preferable to have the system turned on even though the engine is not operating in a strict steady-state condition.

Further, although the shrouds are shown as part of a solid casing, 31 in FIG. 2, the shroud rubbing surface can be comprised of separable coated and segmented bands retained similarly to the vane bands or made as extensions of the vane bands. In this case, clearance control is primarily effected by selectively cooling the shroud supporting structure.

What we claim and desire to be secured by Letters Patent is:

1. An improved clearance control system for a turbomachine including a compressor of the type having a plurality of rotor stages surrounded in close radial relationship by a stator structure, wherein the improvement comprises:

(a) means for introducing the flow of cooling air along an axial path at the outer surface of said stator structure to inhibit thermal growth thereof, said flow-introducing means including means for bleeding motive fluid from said compressor; and (b) means for selectively diverting the flow of cooling air from said axial path during predetermined conditions of turbomachine operation, said flow-diverting means comprising an air exit duct which fluidly communicates with said flow-introducing means.

2. An improved clearance control system as set forth in claim 1 wherein said flow-introducing means includes at one axial point a cooling airflow entrance port leading to the outer surface of the stator structure and, at another axial point, a cooling airflow discharge port leading from the outer surface of the stator structure.

3. An improved clearance control system as set forth in claim 2 wherein said flow entrance port is so disposed as to receive said motive fluid from the turbomachine.

4. An improved clearance control system as set forth in claim 2 wherein said flow discharge port is so disposed as to discharge air radially outwardly.

5. An improved clearance control system as set forth in claim 1 wherein said flow-introducing means further includes at least one flow entrance port fluidly communicating between said compressor and the outer surface of the stator structure.

6. An improved clearance control system as set forth in claim 5 wherein said compressor includes a plurality of stationary vanes and further wherein said at least one flow entrance port is disposed at the trailing edge area of said vanes.

7. An improved clearance control system as set forth in claim 1 wherein said flow-diverting means is adapted to operate during transient operation of the turbomachine.

8. An improved clearance control system as set forth in claim 2 wherein said exit duct includes a valve for controlling the flow of cooling air from said flow-introducing means into said exit duct.

9. A clearance control system for an axial compressor having a plurality of axially spaced compressor stages surrounded by a closely spaced casing comprising:

means for selectively causing the flow of cooling air axially along the outer surface of the casing to control the temperature and size thereof; and means for selectively diverting the axial flow of cooling air from the outer surface of the casing wherein said flow-diverting means comprises a diverting duct and a valve for controlling the flow of cooling air therein.

10. A clearance control system as set forth in claim 9 wherein said flow-causing means includes a cooling air manifold extending axially along said plurality of axially spaced compressor stages and having a flow entrance port and a flow discharge port.

11. A clearance control system as set forth in claim 9 wherein said flow entrance port fluidly communicates with said compressor.

12. A clearance control system as set forth in claim 9 wherein said flow entrance port includes an orifice which passes radially through said casing.

13. A clearance control system as set forth in claim 9 wherein said compressor includes vanes and further wherein said flow entrance port provides for the radial flow of cooling air through portions of said compressor vanes.

14. A clearance control system for an axial compressor having a plurality of axially spaced compressor stages surrounded by a closely spaced casing comprising:

means for selectively causing the flow of cooling air axially along the outer surface of the casing to control the temperature and size thereof within said flow-causing means includes a cooling air manifold extending axially along said plurality of axially spaced compressor stages and having a flow entrance port and a flow discharge port; and means for selectively diverting the axial flow of cooling air from the outer surface of the casing wherein said flow-diverting means comprises a diverting duct which fluidly communicates with said flow entrance port.

15. A clearance control system as set forth in claim 14 wherein said diverting duct includes a valve for controlling the flow of cooling air therethrough.

16. A clearance control system as set forth in claim 15 wherein said valve acts to simultaneously control the flow of cooling air in both the cooling manifold and said diverting duct.

17. A clearance control system as set forth in claim 16 wherein said valve, when placed in one predetermined position, acts to divide the flow of cooling air into a first portion which flows along the outer surface of the casing and a second portion which bypasses the casing and recombines with said first portion in an exit duct.

* * * * *

UNITED STATES PATENT AND TRADEMARK OFFICE

CERTIFICATE OF CORRECTION

PATENT NO. : 4,329,114

DATED : May 11, 1982

INVENTOR(S) : Richard P. Johnston, Malcolm H. Knapp, Charles E. Coulson

It is certified that error appears in the above—identified patent and that said Letters Patent is hereby corrected as shown below:

Column 7, line 12, claim 14, delete "within" and insert --wherein--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*